United States Patent [19]

Suzuki et al.

[11] 4,285,142

[45] Aug. 25, 1981

[54] SUSPENSION TYPE HEAT EXCHANGER

[75] Inventors: Takeshi Suzuki, Kobe; Takashi Hatamori, Miki; Mikio Murao, Kobe; Minoru Nezuka, Kobe; Chikanori Kumagai, Kobe; Masaharu Takagishi, Kobe, all of Japan

[73] Assignee: Kawasaki Jukogyo Kabushiki Kaisha, Kobe, Japan

[21] Appl. No.: 70,199

[22] Filed: Aug. 27, 1979

[51] Int. Cl.[3] ..... F26B 17/10

[52] U.S. Cl. ..... 34/57 E; 34/57 R; 55/459 R; 209/144

[58] Field of Search ..... 34/57 R, 57 E, 10; 55/459 R; 209/144, 211; 210/512 R

[56] References Cited

U.S. PATENT DOCUMENTS

| | | | |
|---|---|---|---|
| 2,316,207 | 4/1943 | Winter | 34/57 E |
| 2,744,338 | 5/1956 | Rothe | 34/57 E |
| 3,364,589 | 1/1968 | Muller | 34/57 E |
| 3,426,513 | 2/1969 | Bauer | 55/459 R |
| 3,481,118 | 12/1969 | Willis et al. | 55/459 R |
| 3,879,856 | 4/1975 | Barr | 34/57 E |
| 4,061,479 | 12/1977 | Holter et al. | 55/459 R |
| 4,108,778 | 8/1978 | Lambert et al. | 210/512 R |

FOREIGN PATENT DOCUMENTS

| | | | |
|---|---|---|---|
| 680053 | 10/1952 | United Kingdom | 34/57 E |

*Primary Examiner*—Larry I. Schwartz
*Attorney, Agent, or Firm*—Jordan and Hamburg

[57] ABSTRACT

A heat exchanger including a separating chamber in the form of a prism having a substantially horizontal center axis and axially elongated. The separating chamber having a collecting chamber disposed beneath it has an inlet duct opening in the separating chamber and connected to one wall of the separating chamber, and an outlet duct opening in the separating chamber and connected to a wall of the separating chamber. The outlet duct may be connected to the wall to which the inlet duct is connected or to another wall parallel to the wall to which the inlet duct is connected. The inlet duct is positioned and oriented in such a manner that a stream of gas and particulate material is introduced therethrough into the separating chamber in a direction tangential to a spiral stream of gas and particulate material formed in the separating chamber, and the outlet duct is positioned and oriented in such a manner that a stream of gas is discharged therethrough from the separating chamber in a direction tangential to the spiral stream of gas and particulate material formed in the separating chamber. The collecting chamber is disposed away from the spiral stream of gas and particulate material formed in the separating chamber.

12 Claims, 7 Drawing Figures

SUSPENSION TYPE HEAT EXCHANGER

BACKGROUND OF THE INVENTION

This invention relates to suspension type heat exchangers for effecting drying, preheating, heating and cooling of particulate material, such as cement, alumina, fly ash, etc., incorporated in a gas stream of high temperature, and more particularly it is concerned with an improvement in or relating to the separating chamber of a heat exchanger of the suspension type for separating the particulate material from its carrier gas flow.

One kind of suspension type heat exchanger of the prior art includes a separating chamber of a cylindrical form having a substantially horizontal center axis for separating particulate material from a gas stream, a collecting chamber of a funnel shape located beneath the separating chamber, an inlet duct connected to the separating chamber along the entire length thereof in such a manner that a gas stream is introduced into the separating chamber tangentially of the circumferential surface of the separating chamber, and an outlet duct connected to one end of the separating chamber or two outlet ducts each connected to one of opposite ends of the separating chamber to extend along the center axis of the separating chamber. In the suspension type heat exchanger of the prior art described hereinabove, gas is drawn or induced to flow into the separating chamber along the entire length of the separating chamber, and a spiral stream of gas and particulate material is generated in the whole of the separating chamber. This type of separating chamber has the disadvantage that it is low in the efficiency of collecting particulate material because a portion of the particulate material to be separated from the gas is discharged together with the gas from the separating chamber through the outlet duct or ducts before reaching the inner wall surface of the separating chamber.

Another type of separating chamber of a suspension type heat exchanger of the prior art is in the form of a cyclone. Still another type of separating chamber relies on inertia, collision or gravity for operation. In the separating chamber of the cyclone type, two types of swirling streams, one type being a stream of forced vortex motion and the other type being a stream of semi-free vortex motion, are generated and the two streams interfere with each other, causing a high pressure loss to occur. The discharged gas is formed into a spiral stream in the outlet duct connected to the upper end of the cyclone and flows upwardly in a spiral stream, so that the particulate material in the outlet duct is displaced radially outwardly by centrifugal forces and does not permit heat exchange to take place satisfactorily. The cyclone has a high angle of inclination in its lower portion and consequently the collecting chamber has a large height. Thus, when a suspension type heat exchanger consists of a plurality of stages of heat exchangers or cyclones, the overall height of the heat exchanger assembly becomes very great. In the separating chamber relying on inertia, collision or gravity, particulate material that has been separated from the gas stream is caused to scatter again in the separating chamber as the gas stream changes its direction of movement, causing a reduction in the efficiency of collecting the particulate material separated from its carrier gas.

SUMMARY OF THE INVENTION

An object of the present invention is to provide a suspension type heat exchanger including a separating chamber of high capability for separating particulate material from carrier gas.

Another object is to provide a suspension type heat exchanger high in the efficiency with which particulate material is separated from carrier gas, low in pressure loss, and having a particulate material collecting section of small height enabling the overall height of the heat exchanger to be reduced.

According to the present invention, there is provided a suspension type heat exchanger comprising a separating chamber in the form of a prism having a substantially horizontal center axis and axially elongated, a collecting chamber located beneath the separating chamber, an inlet duct connected to one wall of the separating chamber, and an outlet duct connected to another wall of the separating chamber, wherein the improvement resides in the arrangement whereby the inlet duct is positioned and oriented in such a manner that it allows a gas flow to be introduced into the separating chamber tangentially to a spiral flow of gas and particulate material formed in the separating chamber and the outlet duct is positioned and oriented in such a manner that it allows a gas flow to be discharged from the separating chamber tangentially to the spiral flow of gas and particulate material in the separating chamber.

DESCRIPTION OF THE PREFERRED EMBODIMENTS

Figure 1:
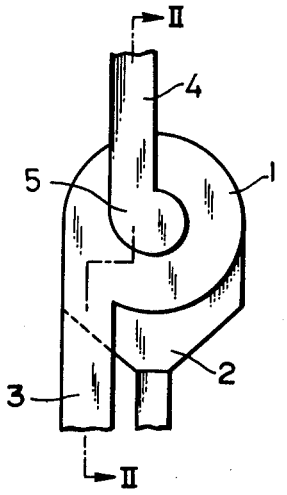
FIG. 1 is a side view of the suspension type heat exchanger comprising one embodiment of the present invention.
Figure 2:
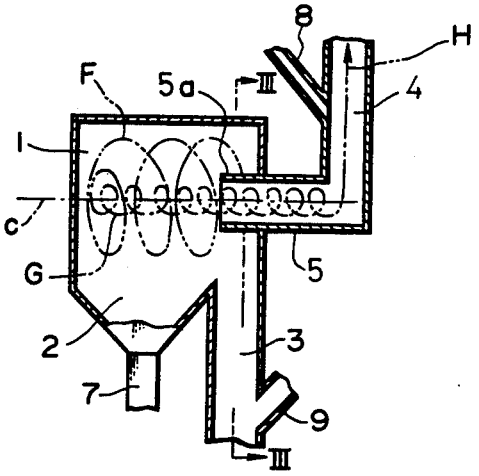
FIG. 2 is a sectional view taken along the line II—II in FIG. 1.
Figure 3:
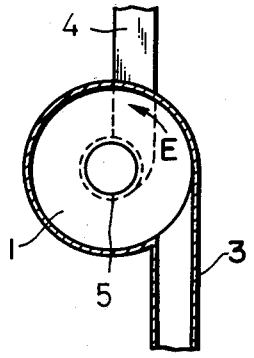
FIG. 3 is a sectional view taken along the line III—III in FIG. 2.

FIGS. 1 to 3 show one embodiment of the invention wherein a separating chamber 1 of the cylindrical shape having a substantially horizontal center axis C is located above a collecting chamber 2 of the funnel shape which is disposed away from the inner circumferential surface of the separating chamber 1. An inlet duct 3 opening in the separating chamber 1 is connected to the outer circumferential surface of the chamber 1 near one end thereof and located tangentially to the outer circumferential surface of the chamber 1. A tubular connecting duct 5 disposed horizontally and opening in the separating chamber 1 is connected to the center or the vicinity of the center of one end of the separating chamber 1 near which the inlet duct 3 is located. An outlet duct 4 is connected to the connecting duct 5 having an end portion extending into the separating chamber 1 to form an inner duct 5*a*. The outlet duct 4 is connected tangentially to the connecting duct 5 and oriented vertically so that a spiral gas flow from the separating chamber 1 is introduced into the outlet duct 4 in the form of a straight gas flow. The inlet duct 1 and outlet duct 4 may be either circular or square in cross sectional shape. A particulate material introducing chute 9 is connected to the inlet duct 3. Connected to the outlet duct 4 midway between two ends thereof is a chute 8 for introducing particulate material to a heat exchanger of the upper stage. A particulate material discharge chute 7 is connected to the lower end of the collecting chamber 2.

In operation, a stream of gas having particulate material incorporated therein is introduced into the separating chamber 1 through the inlet duct 3 at high speed. The stream of gas and particulate material is changed into a spiral stream flowing along the inner circumferential surface of the chamber 1 as indicated by an arrow E. The spiral stream of gas and particulate material flows toward the other end of the chamber 1 as indicated by an arrow F. While the gas flows in a spiral stream, the particulate material is forced by centrifugal forces against the inner circumferential surface of the separating chamber 1 and separated from the gas. The separated particulate material moves downwardly along the inner wall surface of the chamber 1 into the collecting chamber 2 disposed beneath the separating chamber 1, where the particulate material moves downwardly along the converging wall surface of the chamber 2 into the particulate material discharge chute 7.

The collecting chamber 2 is located beneath the separating chamber 1 away from the stream of gas and particulate material so that the particulate material separated and collected in the collecting chamber 2 is prevented from being scattered by the spiral stream in the separating chamber 1 because the separated particulate material is not influenced by the spiral stream.

Meanwhile the spiral gas stream from which the majority of the particulate material has been separated reverses its direction of flow near the other end of the separating chamber 1 and a spiral gas stream of smaller diameter flows through a low pressure portion in the center of the spiral gas stream from the other end of the chamber 1 toward one end thereof as indicated by an arrow G in FIG. 2. The spiral gas stream of smaller diameter flows from the chamber 1 into the connecting duct 5 and flows at the end of the connecting duct 5 into the outlet duct 4. When the spiral gas stream flows into the outlet duct 4, the stream is changed into a straight gas stream as indicated by an arrow H which is tangential to the spiral gas stream in the connecting duct 5. The gas flowing in a straight gas stream in the outlet duct 4 is conductive to minimization of pressure loss and noise production. If necessary, the inner duct 5*a* may be dispensed with.

Figure 4:
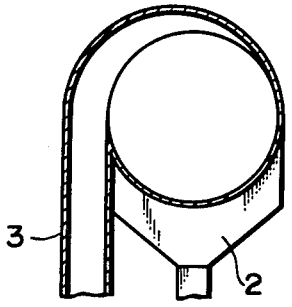
FIG. 4 is a side view of the suspension type heat exchanger comprising another embodiment of the invention.

FIG. 4 shows another embodiment wherein the inlet duct 3 is connected to the cylindrical separating chamber 1 in such a manner that the inner side of the inlet duct 3 is disposed tangentially to the outer circumferential surface of the separating chamber 1 to increase the radius of a spiral gas stream, as contrasted with the embodiment shown in FIGS. 1 to 3 wherein the outer side of the inlet duct 3 is disposed tangentially to the outer circumferential surface of the separating chamber 1.

In the embodiments shown in FIGS. 1 to 4, it is not essential that the connecting duct 5 be connected to the outlet 4 in a manner to be located tangentially to the outlet duct 4. Alternatively, the connecting duct 5 may be connected to the outlet duct 4 in such a manner that the center axes of the two ducts 4 and 5 are in alignment with each other.

As described hereinabove, the suspension type heat exchanger according to the present invention comprises a cylindrical separating chamber having a substantially horizontally center axis, and a collecting chamber located beneath the separating chamber, and an inlet duct for introducing into the separating chamber a gas stream having incorporated therein particulate material is connected to the outer circumferential surface of the separating chamber 1 near one end thereof. By this arrangement, the stream of gas and particulate material introduced into the separating chamber flows in a spiral stream, so that it is possible to increase the path of movement of the stream in the separating chamber without increasing the height of the separating chamber. This enables separation of the particulate material from the gas stream to be effected positively and permits the separated particulate material to be introduced into the collecting chamber with ease. Since the collecting chamber is located beneath the separating chamber away from the inner circumferential surface thereof, the particulated material separated and collected in the collecting chamber is not influenced by the spiral gas stream in the collecting chamber, so that there is no possibility of the separated particulate material being incorporated in the gas stream again. This is conductive to increased efficiency with which the particulate material is separated from the gas. The separating chamber has a substantially horizontal center axis, and this makes it possible to reduce the height of the separating chamber. This arrangement is particularly advantageous when a plurality of separating chambers are arranged one above another to provide a heat exchanger assembly.

The separating chamber is in cylindrical form in the embodiments shown in FIGS. 1 to 4. However, the invention is not limited to this specific form of separating chamber, and the separating chamber may be of any form whose ends are parallel, polygonal and equal in size and shape and whose sides are parallelograms, since the cylindrical shape is considered to be a special case of the form referred to hereinabove wherein the number of the sides is rendered infinite. The most simple of the aforesaid form is a parallelepiped. The embodiment shown in FIG. 5 comprises a separating chamber 21 in the form of a horizontal parallelepiped, and a collecting chamber 22 located beneath the separating chamber 21 and shaped like an inverted pyramid for collecting the separated particulate material. An inlet duct 23 opening in the separating chamber 21 is connected to one side wall 21*a* in a position near one end of the upper side of the side wall 21*a* so as to introduce a gas stream into the separating chamber 21 along a wall 21*b* constituting the top wall of the chamber 21. The inlet duct 23 has a particulate material introducing chute 29 connected midway between the ends thereof. An outlet duct 24 opening in the separating chamber 21 is connected to the top wall 21*b* in a position near the opposite end of the upper side of the side wall 21*a* for discharging the gas stream therethrough from the separating chamber 21 for delivery to the heat exchanger of the upper stage. The numerals 21*d* and 21*e* designate opposite end walls of the separating chamber 21 of the parallelepiped shape. The collecting chamber 22 which is of an inverted pyramid shape is connected at its lower end to a particulate material discharge chute 27, and the outlet duct 24 is connected midway between its opposite ends to a particulate material introducing chute 28 for introducing particulate material to the heat exchanger of the upper stage.

The operation of the embodiment shown in FIG. 5 will be described. A gas stream drawn by suction from the heat exchanger of the lower stage and having particulate material incorporated therein on its way from the lower stage heat exchanger is introduced through the inlet duct 23 into the separating chamber 21 along the top wall 21*b*. The gas stream introduced into the separating chamber 21 flows gradually along the longer sides of the chamber 21 from the end wall 21*d* toward the end wall 21*e* while flowing in a spiral stream in vertical planes as indicated by an arrow A. The particulate material in the gas stream is forced by centrifugal forces against the inner wall surfaces of the separating chamber and separated from the gas stream, so that the separated particulate material moves downwardly along the inner wall surfaces of the separating chamber 21 into the collecting chamber 22, from which the separated particulate material is discharged through the particulate material discharge chute 27 to outside.

The collecting chamber 22 is located beneath the separating chamber 21 and away from the spiral stream of gas and particulate material formed in the chamber 21, so that the separated particulate material is not influenced by the spiral gas stream to be scattered thereby. Since two types of vortex motion are not produced as in the case with the gas stream in a cyclone, the pressure loss in the separating chamber 21 is minimized.

Meanwhile the gas stream from which the particulate material has been separated flows toward the other end 21*e* while flowing in a spiral stream, and is led to the heat exchanger of the upper stage through the outlet duct 24 located tangentially to the spiral stream. The gas entering the outlet duct 24 flows in a straight stream without flowing in a spiral stream, so that the particulate material incorporated in the gas through the particulate material introducing chute 28 can be uniformly dispersed in the gas stream. This enables heat exchange to take place effectively.

Figure 6:
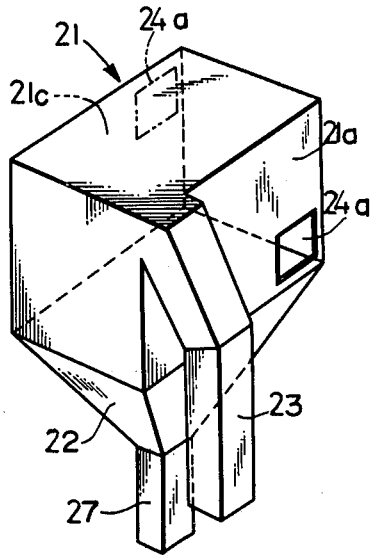
FIG. 6 is a schematic perspective view of the suspension type heat exchanger comprising still another embodiment of the invention.

FIG. 6 shows still another embodiment wherein an opening 24*a* for connecting the separating chamber 21 with the outlet duct 24 is formed in the side wall 21*a* in a position near the end wall 21*e* located substantially diagonally from the position in which the inlet duct 23 is connected to the side wall 21*a*. The opening 24*a* may be formed, as indicated by broken lines, in a side wall 21*c* in a position near the upper side thereof and the end wall 21*e*. That is, the opening 24*a* may be formed in any position in which the outlet duct 24 can be connected with the separating chamber 21 in such a manner that the outlet duct 24 is located tangentially to the spiral stream of gas and particulate material formed in the separating chamber 21. By this arrangement, the gas stream can be led smoothly into the outlet duct 24 and made to flow in a straight stream therethrough.

Figure 7:
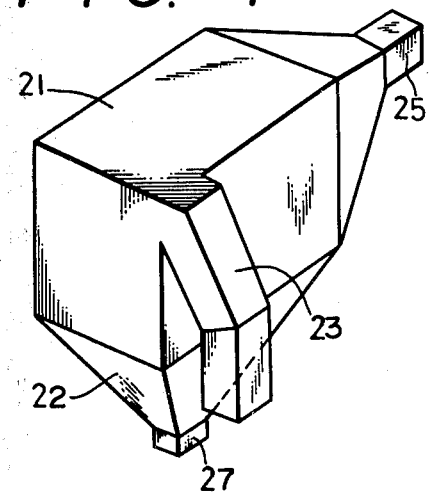
FIG. 7 is a perspective view of the suspension type heat exchanger comprising a further embodiment of the invention.

FIG. 7 shows a further embodiment wherein an end wall of the separating chamber 21 opposite to the end wall thereof along which the inlet duct 23 is connected is replaced by a pyramidal projection having the connecting duct 25 connected to its forward end. In this embodiment, the gas flows in the connecting duct 25 in a spiral stream of small diameter. The connecting duct 25 is connected to an outlet duct, not shown, in the same manner as shown in FIG. 1, so that the gas introduced from the connecting duct 25 to the outlet duct flows therein in a straight stream. The connecting duct may be dispensed with and the gas stream may be directly discharged through the outlet duct 24 with the same results.

Figure 5:
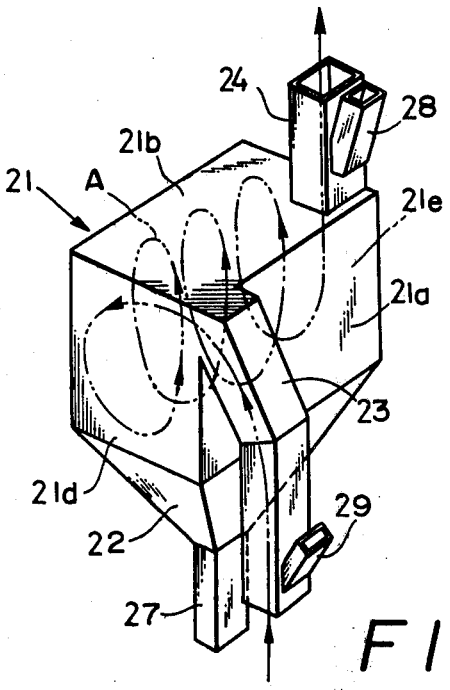
FIG. 5 is a perspective view of the suspension type heat exchanger comprising still another embodiment of the invention.

The walls of the separating chamber 21 each have a plane surface in the embodiments shown in FIGS. 5 to 7. However, the wall of the separating chamber 21 may be curved. The collecting chamber 22 is one in number in these embodiments. However, a plurality of collecting chambers 22 in funnel form may be provided beneath the separating chamber 21.

The embodiments shown in FIGS. 5 to 7 can achieve the same results as the embodiments shown in FIGS. 1 to 4. That is, the particulate material is positively separated from the gas, and the separated particulate material can be led to the collecting chamber with ease. Since the collecting chamber is disposed beneath the separating chamber and away from a spiral gas stream formed in the latter, the separated particulate material in the collecting chamber is not influenced by the spiral gas stream to be agitated and scattered thereby. This is conductive to increased efficiency with which the particulate material is separated from the gas. Unlike cyclone, the separating chamber according to the present invention flows in one direction only without turning back, so that it is possible to reduce power loss in the separating chamber. Moreover, since the separating chamber is in the form of a horizontal parallelepiped having a substantially horizontal center axis, the separating chamber and the collecting chamber can be reduced in height. This makes it possible to reduce the overall height of a heat exchanger assembly having a plurality of separating chambers arranged in superposed relation.

What is claimed is:

1. A suspension type heat exchanger including means for separating solid particulate matter from a gas stream in which said particulate matter is suspended comprising:

an essentially unobstructed separating chamber defined by stationary walls in the form of a prism having a substantially horizontal center axis and being axially elongated;

a collecting chamber located beneath said separating chamber, the collecting chamber and the separating chamber being in unobstructed direct communication with each other; and an inlet duct and an outlet duct each connected to a wall of the separating chamber and each duct communicating with the separating chamber at a location substantially spaced from the location of the other duct along the length of the chamber, the inlet duct and the outlet duct each being oriented non-radially with respect to the axis of the separating chamber and transverse to said axis;

said inlet duct comprising means for introducing into the separating chamber a linearly flowing gas stream in which is suspended solid particulate matter, the orientation of the inlet duct relative to the separating chamber is such as to cause said gas stream to flow spirally about the axis of the separating chamber to the outlet duct, centrifugal force caused by said spiral flow propels the particulate matter outwardly away from the spiral flow thereby allowing the particulate matter to drop into the collecting chamber while the gas stream continues to flow to the outlet duct through which it flows linearly, the separation of the particulate matter from the gas thereby being efficient, the pressure loss in the separating chamber being low and the height of the particulate matter separating means being relatively small due to the horizontal orientation of the separating chamber axis.

2. A suspension type heat exchanger as set forth in claim 1 wherein said inlet duct and said outlet duct are connected to the same wall of the separating chamber.

3. A suspension type heat exchanger as set forth in claim 1, wherein said inlet duct is connected to one of the walls and said outlet duct is connected to the other wall of the separating chamber.

4. A suspension type heat exchanger including means for separating solid particulate matter from a gas stream in which said particulate particularte matter is suspended comprising:

an essentially unobstructed separating chamber defined by stationary walls in the form of a cylinder having a substantially horizontal center axis and being axially elongated;

a collecting chamber located beneath said separating chamber, the collecting chamber and the separating chamber being in unobstructed direct communication with each other; and an inlet duct and an outlet duct each connected to a wall of the separating chamber and each duct communicating with the separating chamber at a location substantially spaced from the location of the other duct along the length of the chamber, the inlet duct and the outlet duct each being oriented non-radially with respect to the axis of the separating chamber and transverse to said axis;

said inlet duct comprising means for introducing into the separating chamber a linearly flowing gas stream in which is suspended solid particulate matter, the orientation of the inlet duct relative to the separating chamber is such as to cause said gas stream to flow spirally about the axis of the separating chamber to the outlet duct, centrifugal force caused by said spiral flow propels the particulate matter outwardly away from the spiral flow thereby allowing the particulate matter to drop into the collecting chamber while the gas stream continues to flow to the outlet duct through which it flows linearly, the separation of the particulate matter from the gas thereby being efficient, the pressure loss in the separating chamber being low and the height of the particulate matter separating means being relatively small due to the horizontal orientation of the separating chamber axis.

5. A suspension type heat exchanger as set forth in claim 4, wherein said inlet duct is connected to one of the walls and said outlet duct is connected to the other wall of the separating chamber.

6. A suspension type heat exchanger as set forth in claim 4, wherein said inlet duct and said outlet duct are connected to the same wall of the separating chamber.

7. A suspension type heat exchanger as set forth in claim 4, 5 or 6 wherein said inlet duct is connected to the separating chamber in such a manner that the outer side of the inlet duct is located tangentially to the outer circumferential surface of the separating chamber.

8. A suspension type heat exchanger as set forth in claim 4, 5 or 6 wherein said inlet duct is connected to the separating chamber in such a manner that the inner side of the inlet duct is located tangentially to the outer circumferential surface of the separating chamber.

9. A suspension type heat exchanger as set forth in claim 1, 3, 4, 5, or 6 wherein said separating chamber is formed as a quadrangular prism and said inlet duct is connected to one side wall of the separating chamber and located at the upper portion and near one corner of said wall.

10. A suspension type heat exchanger as set forth in claim 8 wherein said outlet duct is connected to the wall of the separating chamber distinct from the wall to which said inlet duct is connected, through an outlet duct connected to said wall in alignment with an extension of the center of the separating chamber.

11. A suspension type heat exchanger as set forth in claim 10, said outlet duct is connected to said connecting duct in such a manner that it allows a gas flow to be discharged from the outlet duct tangentially to the spiral flow of gas in the separating chamber.

12. A suspension type heat exchanger as set forth in claim 3 or 2, in which the inlet and outlet ducts are connected to the separating chamber adjacent respective opposite ends of the separating chamber.

* * * * *